United States Patent [19]

Harris

[11] Patent Number: 4,852,468

[45] Date of Patent: Aug. 1, 1989

[54] WORK STATION WITH FUME COLLECTING MEANS

[76] Inventor: Mickey Harris, HCR 61 Box 3, Sumerduck, Va. 22742

[21] Appl. No.: 174,875

[22] Filed: Mar. 29, 1988

Related U.S. Application Data

[63] Continuation of Ser. No. 902,770, Sep. 2, 1986, abandoned, which is a continuation-in-part of Ser. No. 766,016, Aug. 15, 1985, abandoned.

[51] Int. Cl.[4] ..... B08B 15/02

[52] U.S. Cl. ..... 98/115.3; 55/DIG. 18; 132/73; 312/223

[58] Field of Search ..... 55/385 A, 385 G, DIG. 18; 98/115.1, 115.3, 115.4; 132/73, 73.5, 73.6, 75; 312/223

[56] References Cited

U.S. PATENT DOCUMENTS

| | | | |
|---|---|---|---|
| 1,366,370 | 1/1921 | Ellison | 98/115.1 X |
| 1,401,710 | 12/1921 | Koterske | 98/115.1 X |
| 2,082,374 | 6/1937 | Angus | 98/115.1 |
| 2,422,330 | 6/1947 | Allerdice | 98/115.1 X |
| 4,179,984 | 12/1979 | Gurcey | 98/115.3 |
| 4,246,058 | 8/1982 | Rigsby | 98/115.1 X |
| 4,248,162 | 2/1981 | Skeist | 98/115.1 X |
| 4,359,060 | 11/1982 | Walker | 132/75 |
| 4,512,245 | 4/1985 | Goldman | 55/DIG. 18 X |
| 4,553,992 | 11/1985 | Boissinot et al. | 98/115.1 X |

FOREIGN PATENT DOCUMENTS

| | | | |
|---|---|---|---|
| 660716 | 11/1951 | United Kingdom | 98/115.3 |
| 778321 | 7/1957 | United Kingdom | 55/DIG. 18 |

*Primary Examiner*—Harold Joyce

*Attorney, Agent, or Firm*—Dennis H. Lambert

[57] ABSTRACT

A ventilated work station for sculpting fingernails includes a horizontal work platform supported at its opposite ends on pedestals, one of said pedestals containing at least one drawer for storing tools and supplies, and wherein the at least one drawer is reversible in the pedestal to convert the work station from the left-hand configuration to a right-hand configuration. A transparent hood is supported on and covers a portion of the platform and has low profile access slots in opposite sides thereof for insertion of the hands of a nail technician and a customer. That portion of the platform beneath the hood has slots therethrough for conveying heavier than air fumes downwardly through the platform, and the hood captures lighter than air fumes. An exhaust fan is connected with ducts leading to the hood and slots for producing a low pressure in the area confined by the hood to convey collected fumes away from the work area.

5 Claims, 3 Drawing Sheets

WORK STATION WITH FUME COLLECTING MEANS

This application is a continuation of U.S. application Ser. No. 902,770, filed Sept. 2, 1986, now abandoned, and which is, in turn, a continuation-in-part of application Ser. No. 766,016, filed Aug. 15, 1985, and now abandoned.

FIELD OF THE INVENTION

This invention relates generally to apparatus for removing toxic fumes. More specifically, the invention relates to an apparatus for use in sculpturing finger nails, wherein means is provided for removing toxic fumes from the work area.

DESCRIPTION OF THE PRIOR ART

Various methods and devices exist in the prior art for repairing broken finger nails, and/or for applying false or artificial nails. One such method which has gained substantial popularity is the application of acrylic materials to form a sculpted nail. In some instances, these nails are produced for later application to the fingers of a customer, but many beauty salons and shops specializing in nail care construct the sculpted nails directly on the fingers of a customer. The manufacture of such nails requires the use of a number of toxic materials, including solvents and hardeners and the like. In particular, such materials typically contain ethyl methacrylate, which is a highly toxic material that can cause hypotension, headaches, shortness of breath and nausea, and can even lead to cardiac arrest.

Nail technicians typically work at a small table, with the customer seated on one side and the technician seated on the other side. The customer's fingernails are prepared with solvents and the sculpted nail is then built up using acrylics. Multiple applications are usually made, each followed by a drying period during which volatile components evaporate into the atmosphere, and sanding to shape the nail. During this process, cotton balls,tissues and other tools become saturated with the chemicals. As a result, a substantial quantity of toxic fumes are introduced into the atmosphere surrounding the work table, leading to potentially serious consequences for both the nail technician and the customer. The problem is particularly acute for the technician, who often performs nail sculpturing services for many customers during the course of a day. In many shops which have multiple work stations, toxic fumes can reach hazardous levels throughout the shop, endangering all of the customers and employees in the shop.

In an effort to alleviate these problems, exhaust fans and/or hoods have been provided in some prior art facilities to vent the toxic fumes away from the work area. However, these devices typically only reduce the amount of toxic fumes in the atmosphere and do not eliminate them, since they are not constructed to substantially enclose the work area and/or to remove both the heavy and light components of the toxic fumes. In this regard, it should be noted that materials used in the sculpting of nails include components which are lighter than air and components which are heavier than air. Consequently, a simple hood and exhaust fan will only draw away the lighter components. Moreover, if the work area is not enclosed, a substantial amount of fumes can escape the influence of the exhaust fan.

Similar problems have been encountered in other professions, such as in the fields of graphic arts, histopathology and manufacture of ceramic objects. In PALMER, et al. (U.K. Pat. No. 778,321) an apparatus is disclosed for removing the toxic dust and particles resulting from the fettling of ceramic ware. In this apparatus, work is performed on a mesh platform 12, through which dust and particles fall into a drawer 11. Lighter dust particles are drawn through exhaust 20, 22. The platform work area is enclosed on three sides by a wall 16, the exhaust outlet 21 and a hood 17. The worker gains access to the work through the open side of the apparatus. There is no thought or suggestion of two persons having access to the work platform from opposite sides, or of using exhaust fan means to draw both heavy and light components of toxic fumes from the work area, or of providing reversible drawers, lighting means, etc.

The patent to GOLDMAN (U.S. Pat. No. 4,512,245) describes an apparatus intended for use in histopathology or graphic arts, in which a curved pipe 15 has an intake 60 on one end thereof disposed closely above a work station for drawing lighter than air fumes. Heavier than air fumes are exhausted downwardly through the work platform itself. However, this patent fails to suggest the unique combination of elements, including the hood with openings on opposite sides for gaining access to the work platform by a technician and a customer, or the light means, or the reversible drawers, etc.

U.S. Pat. No. 4,359,060 to WALKER discloses an apparatus for dispensing nail polish, in which pivoted brackets 31 and 33 are mounted on a superstructure 12. The object of this patent is to provide a means for enabling nail polish and remover to be dispensed without spilling the polish and remover over rugs, clothes or furniture. There is not any exhaust means or hood disclosed as contemplated in the present invention, nor are there reversible drawers, light means, etc.

SUMMARY OF THE INVENTION

Accordingly, it is an object of this invention to provide an apparatus for venting toxic fumes from the work area during sculpting of fingernails.

A more specific object is to provide an apparatus for collecting and venting both heavier than air and lighter than air components from a work area during sculpting of fingernails.

Another object is to provide a work station for sculpting fingernails, in which a platform is provided for supporting the hand(s) of the person whose nails are being sculpted, with vent means in the platform for venting away heavier than air components of toxic fumes emitted during the sculpting process, and in which a hood substantially encloses the area above the platform for exhausting the lighter than air components.

A further object of the invention is to provide a work station for sculpting fingernails, wherein a work platform is supported on a base or pedestals including stacked drawers which are reversible in their pedestal to change the work station form a right-hand configuration to a left-hand configuration.

Yet another object of the invention is to provide a work station for sculpting fingernails, in which a vented platform is provided for supporting the hands of a person whose nails are being sculpted and a vented hood is positioned over the platform for collecting and venting both heavier than air and lighter than air toxic fumes form the work area, respectively, the hood having low profile elongate slots for access of the hands of the nail technician and the customer during the sculpting process.

An even further object of the invention is to provide a work station for sculpting nails, in which a transparent vented hood is supported above a vented work platform, with low profile access slots on opposite sides of the hood for enabling the nail technician and the customer to place their hands over the work platform from opposite sides of the hood.

Yet another object of the invention is to provide a low maintenance vented work station for sculpting nails, wherein toxic fumes are vented away from the work area by an exhaust fan.

These and other objects and advantages of the invention are achieved by the unique and simple apparatus discovered by applicant, wherein a work platform is supported at its opposite ends on pedestals. One of the pedestals comprises a stack of drawers which are reversible in the pedestal to convert the work station for use by either a left-hand person or a right-hand person. The platform is vented for removing heavier than air fumes emitted during the nail sculpting process. A transparent hood is mounted on the platform above the work area, completely enclosing the work area except for a low profile slot on each side through which the hands of a customer and a nail technician may be inserted for access to the work platform. The hood is ventilated for drawing away lighter than air components emitted during the sculpting process, and a light is positioned in the hood to provide light to the work area. The exhaust means for venting the toxic fumes away from the work area comprises a simple duct system and exhaust fan, and does not include any filters or other equipment requiring service or periodic replacement, thus rendering the apparatus relatively maintenance free. The resulting work station is exceptionally simple and inexpensive to manufacture and use, and provides an environmentally safe means for performing nail sculpting services.

BRIEF DESCRIPTION OF THE DRAWINGS

The foregoing objects and advantages will become apparent from the following detailed description and accompanying drawings, wherein like reference characters designate like parts throughout the several views, and wherein.

DETAILED DESCRIPTION OF THE PREFERRED EMBODIMENTS

Figure 1:
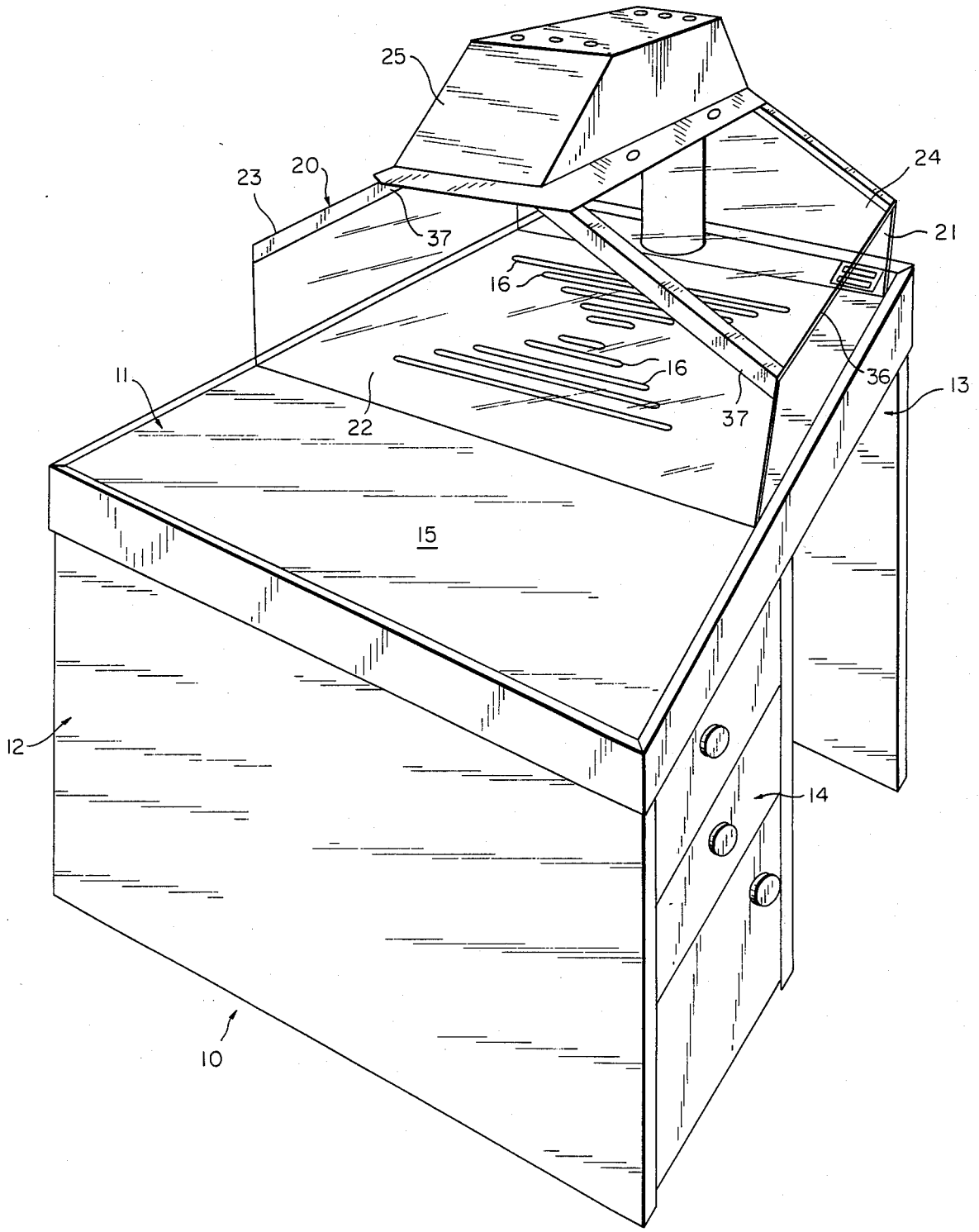
FIG. 1 is a top perspective view of the work station of the invention.
Figure 2:
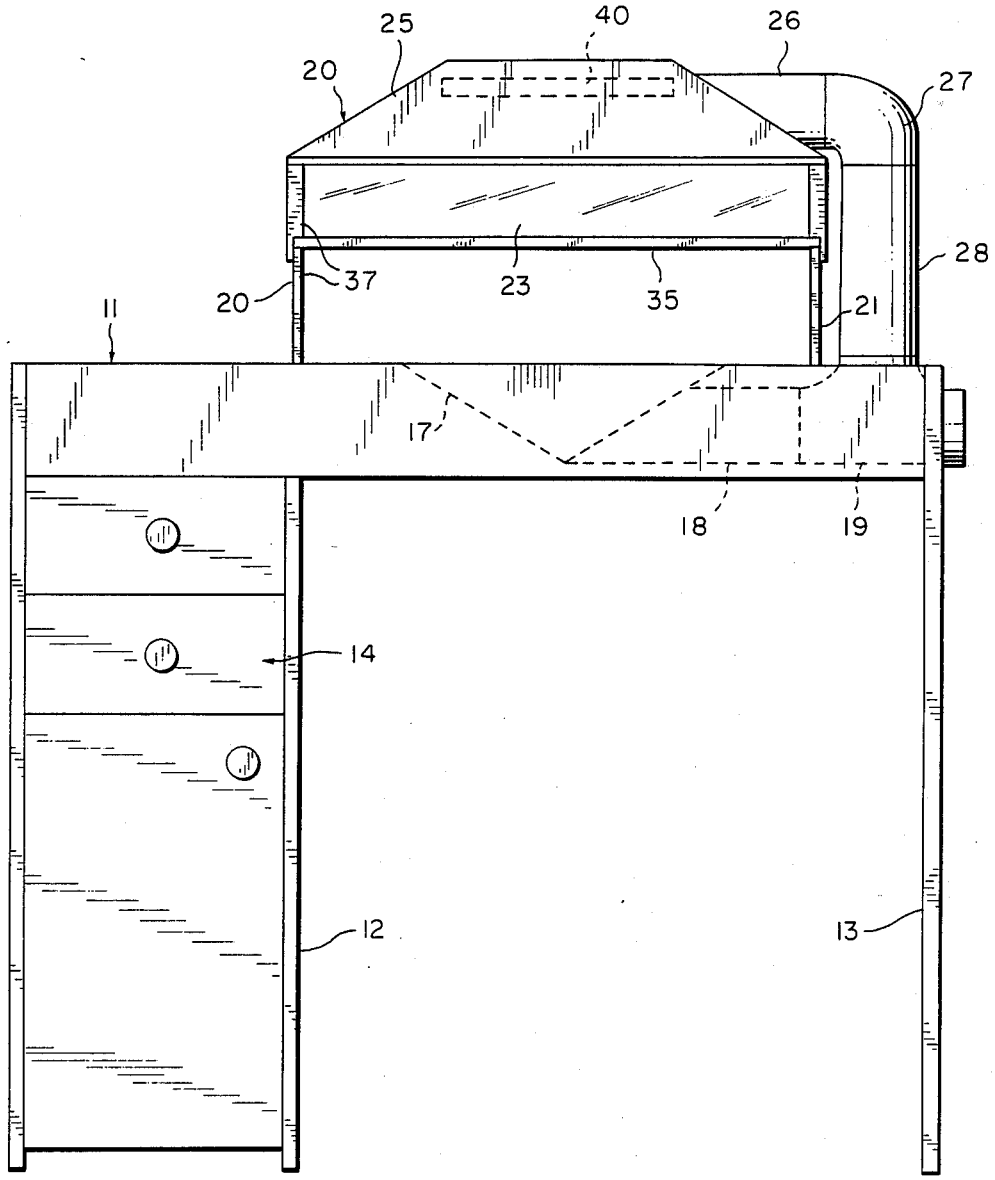
FIG. 2 is a front view in elevation of the work station, showing the drawer stack reversed from the configuration shown in FIG. 1.
Figure 3:
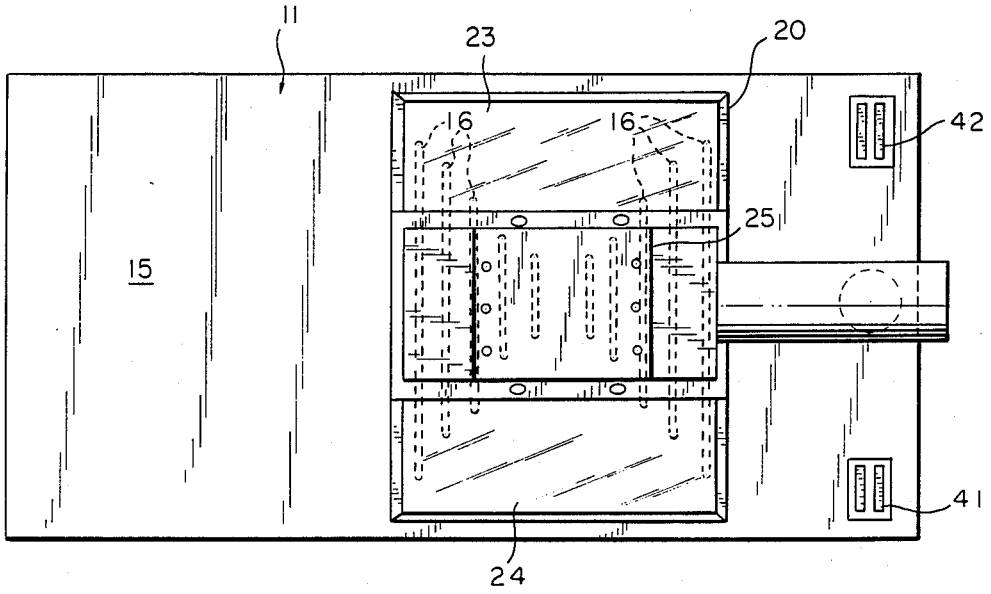
FIG. 3 is a top plan view of the work station.

Referring more particularly to the drawings, the work station is indicated generally at 10 and comprises a flat, rectangularly shaped work platform 11 supported at its opposite ends on pedestals 12 and 13. One of the pedestals contains a stack of drawers 14 which are reversible in the pedestal to convert the work station from use by a left-hand person as shown in FIG. 1 to use by a right-hand person as shown in FIG. 2. The drawers 14 are used for storing supplies, tools, and the like for use in sculpting nails. In addition, the work platform includes an end portion 15 which remains unencumbered for holding various tools and materials used during a nail sculpting process.

Slots 16 in the work platform communicate with a collector 17 concealed within the work platform, and the collector is connected with an exhaust duct 18 joined to a T-connector 19 at the side of the platform. The T-connector is intended to be joined to an exhaust duct (not shown) leading to a suitable fan means (not shown) for conveying heavier than air fumes downwardly through the slots and outwardly through the ducts to a site away from the work environment.

Figure 4:
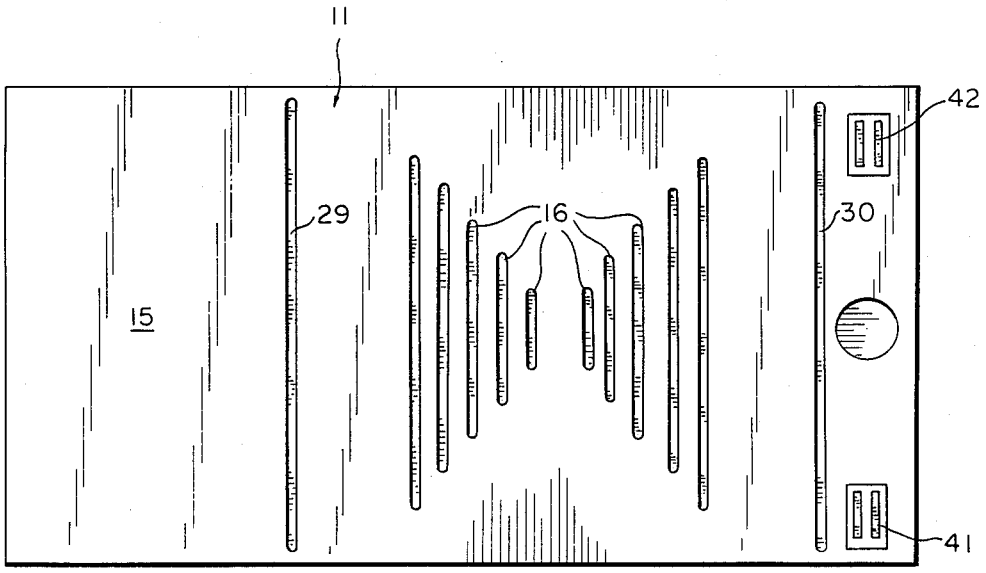
FIG. 4 is a top plan view of the work platform, showing the hood removed for purposes of clarity.

A transparent hood 20 is supported on the work platform and includes opposite end walls 21 and 22, downwardly sloping top walls 23 and 24, and a collector 25. Duct 26 is connected with the collector 25 and leads through an elbow 27 and duct 28 to the T-connector 19, whereby lighter than air fumes are trapped under the hood and are conveyed through the ducts by the exhaust fan and away from the work area. As seen best in FIG. 4, the bottom edges of the end walls 21 and 22 are received in slots 29 and 30 formed in the top surface of the platform to stabilize the hood on the platform and to ensure that the fumes are confined to the area under the hood.

The bottom ends or edges of the top walls 23 and 24 are spaced closely above the top of the platform to define low profile access slots 35 and 36, through which the hands of a nail technician and a customer can be extended to rest on the work area of the platform above the slots.

The transparent panels of the hood can be made of any suitable material, such as plastic or glass, and are joined at their mating edges by suitable couplings, such as metal or plastic strips 37.

A light fixture, such as fluorescent light 40, is supported in the hood at the top of the collector for providing adequate light to the work area, and switches or controls 41 and 42 for operating the light and/or the exhaust fan are mounted in the top of the platform on opposite sides thereof for convenient access by the nail technician from either side of the work station.

In use, a nail technician sits on one side of the platform and a customer sits on the other side, with their hands inserted through the access slots 35 and 36. The transparent hood enables both the customer and the technician to readily view the work, and at the same time substantially all of the toxic fumes emitted during the sculpting process are captured by the hood and vented away from the work area.

Although the invention has been described with reference to a particular embodiment, it is to be understood that this embodiment is merely illustrative of the application of the principles of the invention. Numerous modifications may be made therein and other arrangements may be devised without departing from the spirit and scope of the invention.

I claim:

1. A ventilated work station for sculpting fingernails, comprising:

a flat, horizontal work platform supported at its opposite ends on pedestals;

one of said pedestals containing at least one drawer for storing tools and supplies;

ventilation slots formed in one end portion of said platform over a work area thereof for conveying heavier than air fumes downwardly through the platform;

a collector beneath said slots for collecting the fumes conveyed downwardly therethrough;

a transparent ventilation hood supported on top of said platform for confining to the area beneath the hood those fumes emitted during a nail sculpting process performed in the work area, said hood extending over and covering only that portion of the platform defining the work area and having the slots therein, whereby a portion of said platform remains free for placement of tools and supplies used in a nail sculpting process, said hood having opposite end walls with bottom edges thereof engaged on top of said platform, and downwardly sloping top walls extending at bottom edges thereof to closely spaced positions above the platform, defining with said platform low profile access slots on opposite sides of the platform through which a nail technician and a customer, respectively, can insert their hands for sculpting fingernails on the hands of the customer, the transparent sloping top walls enabling the technician and customer to view the work area and defining a collector .for collecting lighter than air fumes emitted during the nail sculpting process;

duct means connected to the collectors for conveying fumes away from the work area; and exhaust fan means connected with the duct means for producing a low pressure in the work area beneath the hood for drawing away the fumes collected during a nail sculpting process.

2. A ventilated work station as claimed in claim 1, wherein:

a light fixture is supported beneath said hood for lighting the work area.

3. A ventilated work station as claimed in claim 2, wherein:

said at least one drawer is reversible in said pedestal for converting the work station from a left-hand configuration to a right-hand configuration.

4. A ventilated work station as claimed in claim 3, wherein:

the bottom edges of the side walls of said hood are engaged in slots formed in the top of the platform.

5. A ventilated work station as claimed in claim 4, wherein:

the collector for collecting fumes flowing downwardly through the slots in the platform is concealed in the platform.

* * * * *